United States Patent [19]

Thomas

[11] 4,125,052

[45] Nov. 14, 1978

[54] AMMUNITION RACK FOR TANK TURRET

[75] Inventor: Richard J. Thomas, Royal Oak, Mich.

[73] Assignee: The United States of America as represented by the Secretary of the Army, Washington, D.C.

[21] Appl. No.: 794,909

[22] Filed: May 9, 1977

[51] Int. Cl.[2] ..... F41H 7/06

[52] U.S. Cl. ..... 89/34; 89/36 K; 89/45; 211/89; 248/313

[58] Field of Search ..... 89/1.5 C, 1.5 G, 1.5 H, 89/34, 45; 206/3; 211/89; 248/311.1 R, 313

[56] References Cited

U.S. PATENT DOCUMENTS

| | | | |
|---|---|---|---|
| 2,010,511 | 8/1935 | Crawford | 89/1.5 C |
| 2,380,737 | 7/1945 | Elliott | 89/1.5 G |
| 2,432,802 | 12/1947 | Reynolds | 89/45 |

*Primary Examiner*—Stephen C. Bentley
*Attorney, Agent, or Firm*—Peter A. Taucher; John E. McRae; Nathan Edelberg

[57] ABSTRACT

Mechanism for releasably retaining a projectile in an upright position within a military tank. A solenoid-controlled pawl releasably engages a side surface of the projectile to retain said projectile in position. Energization of the solenoid withdraws the pawl from the projectile surface, thereby enabling the soldier to remove the projectile from the mechanism.

2 Claims, 10 Drawing Figures

Fig-1
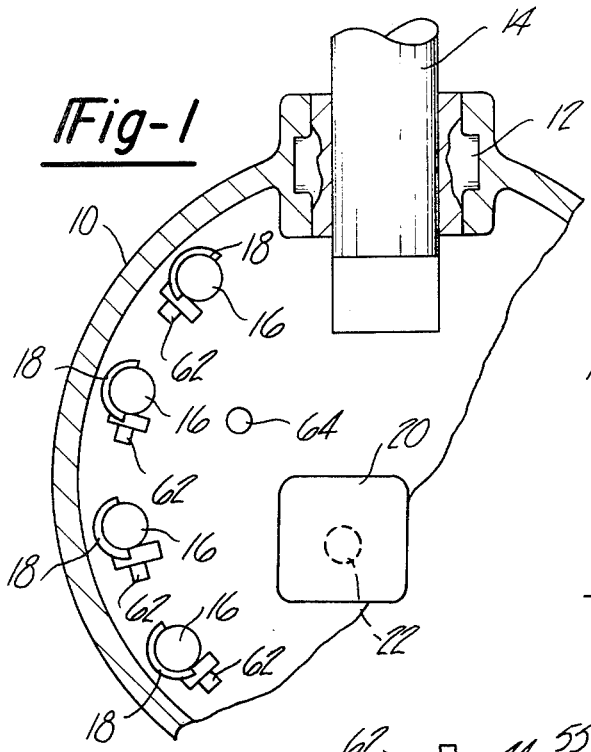
Fig-2
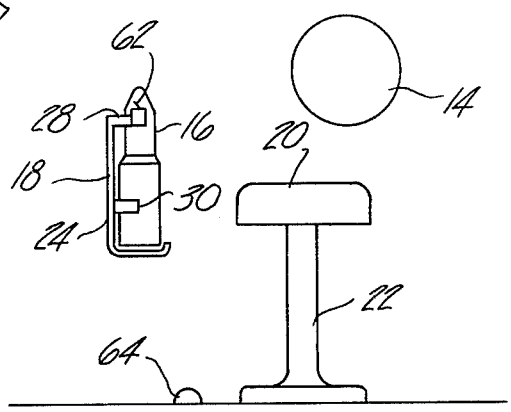
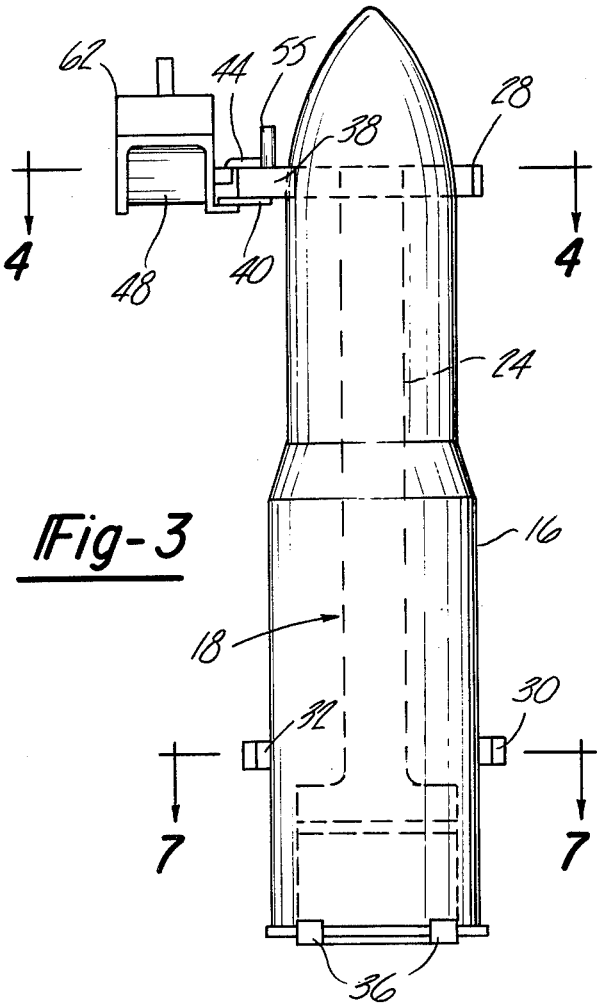
Fig-3

AMMUNITION RACK FOR TANK TURRET

BACKGROUND AND SUMMARY OF THE INVENTION

In the stowage of ammunition, e.g. 105 mm. shells, within military tanks it is conventional practice to store some of the shells (projectiles) in vertical positions relatively near to the gun. The storage racks for such projectiles are designed to enable the soldier to quickly and easily remove the individual projectiles from the racks and load same into the gun. Usually the racks include manually-actuable clamps, straps and/or buckles which must be disengaged before the projectile can be freed for removal from the racks; a period of time is required for the unbuckling function. An object of the present invention is to replace these manually-actuable clamps, straps and buckles with a solenoid-actuated clamp of relatively low cost construction. The clamp is designed for quick actuation, relatively easy access, secure clamping capability, rugged construction, small space utilization, and non-interference with a new projectile being loaded into the rack.

The invention described herein may be manufactured, used, and licensed by or for the Government for governmental purposes without payment to me of any royalty thereon.

THE DRAWINGS

FIG. 1 is a fragmentary schematic plan view of a tank turret showing the orientation of gun, projectile stowage rack, and loader station utilizing the present invention. This general orientation is conventional.

FIG. 2 is a side elevational view of the FIG. 1 arrangement.

FIG. 3 is a front elevational view of a rack mechanism embodying the invention.

Figure 6:
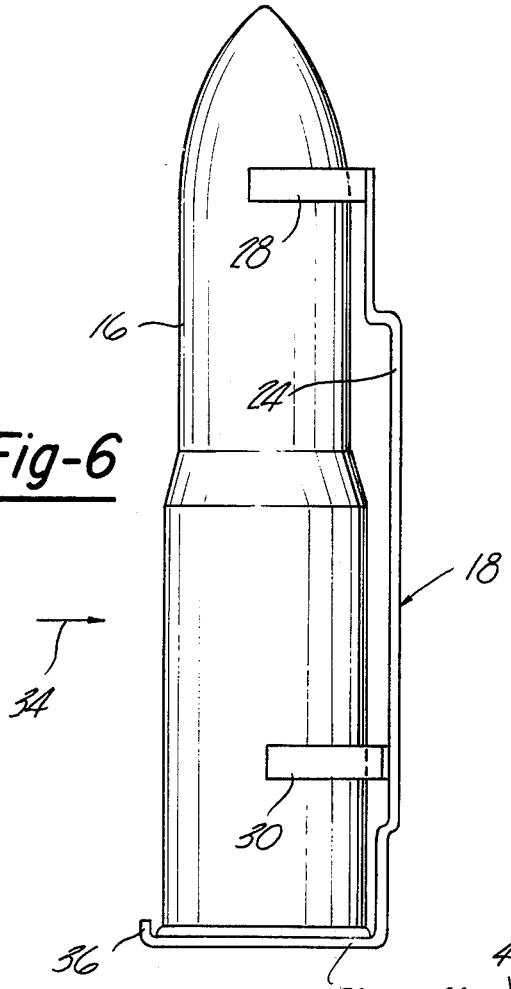
FIG. 6 is a side elevational view of the FIG. 3 rack mechanism.
Figure 7:
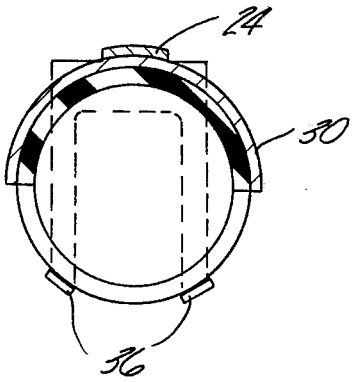
FIG. 7 is a sectional view taken on line 7—7 in FIG. 3.

Referring especially to FIGS. 1 and 2, there is fragmentarily shown a tank turret 10 having a trunnion means 12 for mounting the gun 14 for movement in the elevational direction. Individual projectiles 16 are stored in upright positions within racks 18 located near the turret wall. A soldier seated on stool 20 can reach over and remove a projectile from each rack mechanism when it becomes necessary to load the projectile into the gun. The stool may be rotatable about the axis of pedestal 22 to make it easier for the soldier to go through the various motions necessary to transfer each projectile from its rack to the gun.

The structure of each rack mechanism 18 is better shown in FIGS. 3 and 6. As there shown, the rack comprises an upright bar 24 having a forwardly turned ledge wall 26 at its lower end for supporting the projectile weight. Two semi-circular backstops 28 and 30 are secured to bar 24 near its upper and lower ends. Each backstop is preferably equipped with a resilient rubber pad 32 for minimizing rattle or wobble of the seated projectile.

Figure 4:
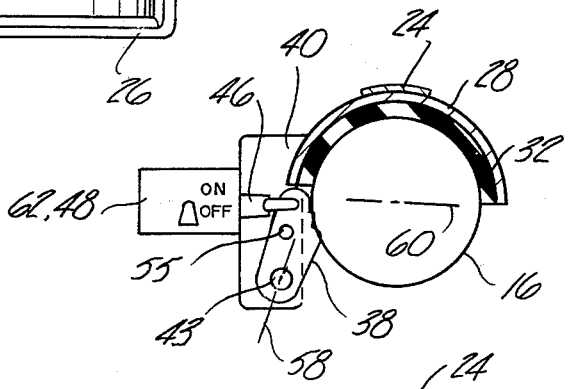
FIG. 4 is a sectional view taken on line 4—4 in FIG. 3.
Figure 5:
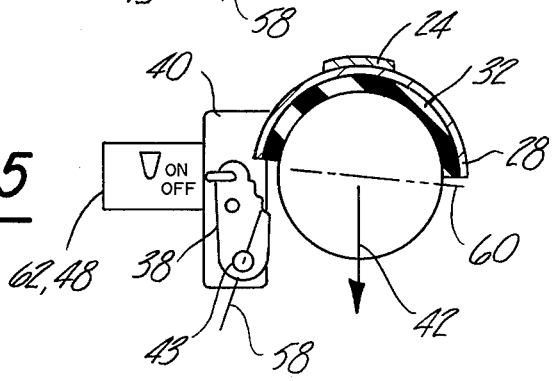
FIG. 5 is a view in the direction of FIG. 4, but taken with the clamp in a projectile-released position.

Loading of a projectile into the rack is accomplished by front-to-rear movement thereof toward the backstops, as denoted by arrow 34 in FIG. 6; after the projectile is seated against the backstops it is lowered slightly to rest on ledge 26. Upstanding flanges or lips 36 on ledge wall 26 prevent the lower end of the projectile from slipping or dropping off the ledge in the forward direction. The upper portion of the projectile is prevented from forward toppling movement by a pawl-type clamp element 38 swingably mounted on a bracket 40 which is integral with or otherwise connected to backstop 28. FIG. 4 shows pawl 38 in the clamped position obstructing movement of the projectile from the rack mechanism. FIG. 5 shows the pawl in a nonobstruct position wherein the projectile is freed for manual removal from the rack in the arrow 42 direction. Preferably backstop 28 and pawl 38 are in a plane wherein they engage the tapered nose area of the projectile; they cooperatively prevent the projectile from being bumped upwardly off of ledge 26.

Figure 8:
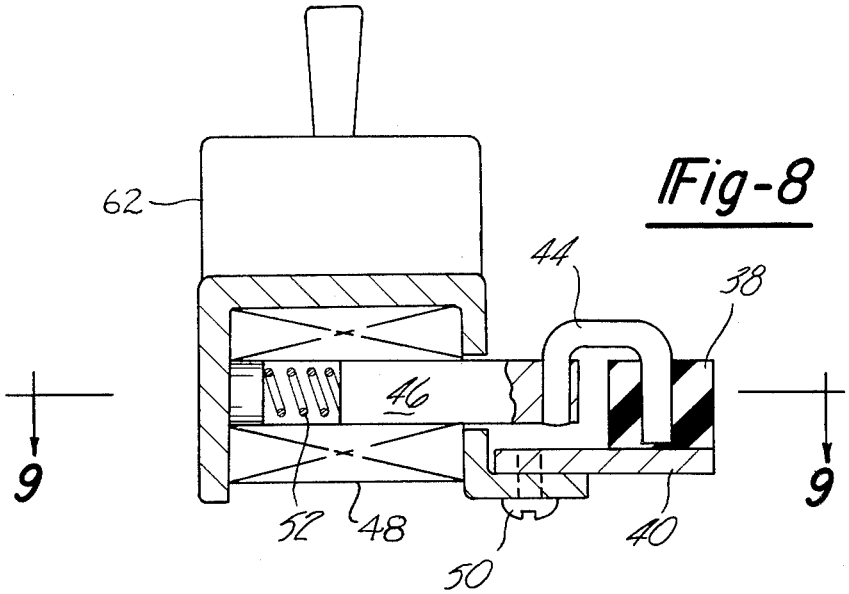
FIG. 8 is an enlarged sectional view of the clamp used in the FIG. 3 rack mechanism.
Figure 9:
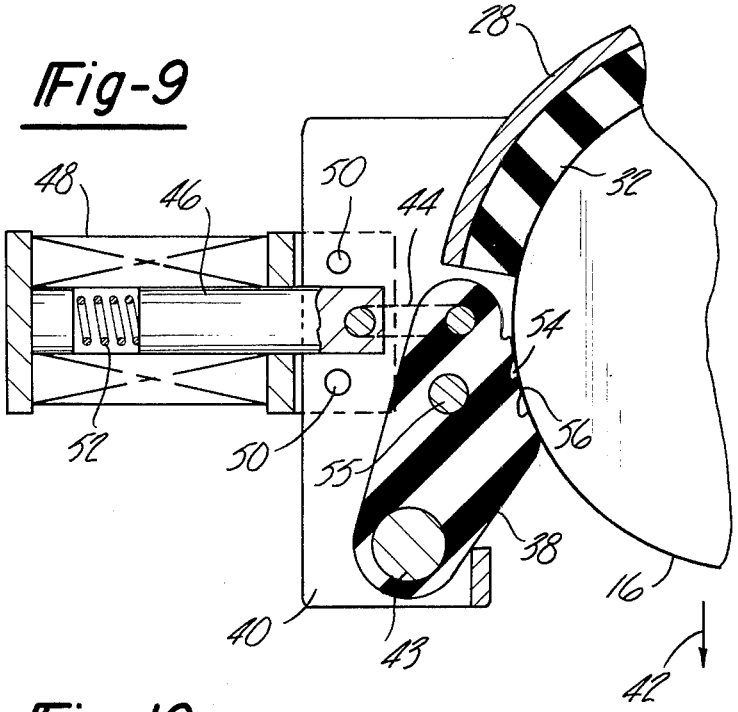
FIG. 9 is a sectional view taken on line 9—9 in FIG. 8.

The structure of pawl 38 is most apparent from FIGS. 8 and 9. As there shown, the pawl consists of a resilient elastomeric block swingably mounted on bracket 40 by means of an upstanding pivot pin 43. The end of the pawl remote from pin 43 is connected to a link 44 that is in turn connected to armature plunger 46 for a conventional solenoid 48. The solenoid may be rigidly secured to bracket 40 via screws 50.

When solenoid 48 is electrically energized the armature 46 is drawn leftwardly (FIGS. 8 and 9), to thereby swing pawl 38 in a counterclockwise direction about the axis of pivot pin 43. When solenoid 48 is de-energized a spring 52 moves armature 46 and the connected pawl back to the FIG. 9 position. Link 44 minimizes any binding tendencies incident to the translation of rectilinear armature motion into swinging pawl motion.

Figure 10:
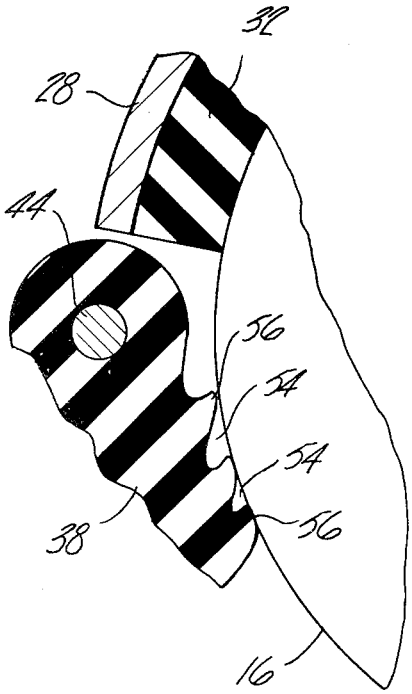
FIG. 10 illustrates a structural detail not clearly apparent from FIG. 9.

The projectile-engagement surface of the pawl may be grooved or serrated, as at 54, to form resilient teeth 56; such teeth may be slightly compressed and deformed by the action of spring 52, thereby slightly increasing the projectile-retention action (in the FIG. 9 position). As best seen in FIG. 10, teeth 56 are obliquely angled outwardly and rearwardly toward backstop 28. Such oblique angling, in combination with the compressive action of spring 52, enables each resilient tooth 56 to act as an overcenter detent, thereby providing further projectile-retention assurance without necessitating an inordinately large powerful solenoid.

It will be seen from FIGS. 4 and 5 that the pawl pivot pin 43 is located forwardly and laterally of the backstop 28 on an imaginary line 58 tangent to the backstop circumference and slightly oblique to the plane of the backstop mouth opening referenced by numeral 60. This orientation of the pawl pivot axis is advantageous in that projectile dislodgement force in the arrow 42 direction tends to rotate the pawl in a clockwise direction, i.e. in the direction that tightens the pawl against the projectile. Spring 52 and solenoid 48 can accordingly be low power devices.

The location of pawl pivot pin 43 is also advantageous during the period while a new projectile is being loaded into the rack mechanism. Thus, as the projectile is manually moved toward backstop 28 the pawl is automatically pushed aside by the projectile. When the projectile contacts the rubber pad 32 the spring 52 automatically swings pawl 38 in a clockwise arc to its projectile-obstruct position.

The projectile-unloading operation requires a means for energizing and de-energizing solenoid 48. This may be accomplished by a manual toggle switch 62 suitably mounted atop the frame of the solenoid. The switch is located in series with the solenoid winding. As an added safety factor against inadvertant dislodgement of a projectile from its rack there may be provided a second master switch in series with individual ones of the various switches 62. FIGS. 1 and 2 show a foot-operated switch 64 that may be used as a master switch for the four illustrated individual switches 62.

As a safety feature, it is desired to provide for easy actuation of pawl 38 in the event that solenoid 48 fails to pull in the armature 46, as for example on disruption of the electrical power supply. The pawl is sufficiently exposed that it would be possible to manually apply finger pressure on an edge of the pawl for moving it counterclockwise to the disengaged position. However the soldier's finger could become pinched between the pawl and projectile surface. To provide an easier mode of manual actuation I equip the pawl with an upstanding pin 55 that can serve as a manual handle for pawl actuation.

I wish it to be understood that I do not desire to be limited to the exact details of construction shown and described for obvious modifications will occur to a person skilled in the art.

I claim:

1. Mechanism for retaining a projectile in an upright position within a military tank: said mechanism comprising a semi-circular open-mouthed backstop having an internal diameter that is essentially the same as the projectile diameter, whereby the projectile can be snugly seated against the backstop without wobble; a bracket carried by the backstop; a pawl swingably mounted on the bracket for movement between a first position obstructing removal of the projectile from the backstop, and a second position permitting removal of the projectile from the backstop; a solenoid mounted on the bracket remote from the pawl swing axis; a solenoid armature operatively connected to the pawl for drawing same away from the mouth of the backstop to its second position when the solenoid is energized; and spring means for projecting the pawl to its second position when the solenoid is de-energized; the mouth opening of the backstop lying in a plane (60) that substantially intersects the axis of the seated projectile; the swing axis of the pawl being located forwardly and laterally of the backstop mouth opening; the pawl having a projectile-engagement surface that moves substantially parallel to the plane of the backstop mouth opening as the pawl approaches the projectile surface; the location of the pawl swing axis being such that the pawl can be pushed aside by the projectile as the projectile is moved to a position seated against the backstop.

2. The mechanism of claim 1: said pawl having a resilient elastomeric projectile-engagement surface that is grooved to form resilient teeth; said grooves extending from the plane of the pawl surface in the direction of the pawl swing axis whereby the teeth are deflectable in circumferential directions measured around the pawl swing axis.

* * * * *